US006568010B1

(12) United States Patent
Ames

(10) Patent No.: US 6,568,010 B1
(45) Date of Patent: May 27, 2003

(54) UNIVERSAL HAND SURGERY TABLE

(76) Inventor: Elliot L. Ames, 1878 Rte. 70 East, Suite 5, P.O. Box 4474, Cherry Hill, NJ (US) 08034-0681

( * ) Notice: Subject to any disclaimer, the term of this patent is extended or adjusted under 35 U.S.C. 154(b) by 0 days.

(21) Appl. No.: 09/667,658

(22) Filed: Sep. 22, 2000

Related U.S. Application Data

(60) Provisional application No. 60/156,091, filed on Sep. 24, 1999.

(51) Int. Cl.[7] ..... A61G 13/00
(52) U.S. Cl. ..... 5/646; 5/623; 5/621
(58) Field of Search ..... 5/646, 647, 648, 5/650, 507.1, 623, 624

(56) References Cited

U.S. PATENT DOCUMENTS 2,609,261 A * 9/1952 Parker ..... 5/646
4,054,282 A * 10/1977 Hamer ..... 5/610
6,195,820 B1 * 3/2001 Heimbrock et al. ..... 5/623

* cited by examiner

*Primary Examiner*—Heather Shackelford
*Assistant Examiner*—Fredrick Conley
(74) *Attorney, Agent, or Firm*—Woodcock Washburn LLP

(57) ABSTRACT

A hand surgery table has a top for supporting a patient's arm during hand surgery. A concave end of the hand surgery table accommodates the attending surgeon's torso so that the attending surgeon may sit comfortably. A tongue-shaped end portion extends from the end opposite the concave end for securing the hand surgery table to a conventional operating table where the patient may lie and rest his or her forearm on the hand surgery table top. Elbow support structures are attached to respective sides of the hand surgery table and have convex peripheries for the attending surgeon and the nurse assistant to rest their elbows and forearms. The elbow support structures are retractable to the underside of the table and are moveable longitudinally along the hand surgery table.

19 Claims, 1 Drawing Sheet

UNIVERSAL HAND SURGERY TABLE

CROSS-REFERENCE TO RELATED APPLICATION

This application claims priority hereunder pursuant to 35 U.S.C. 120 to U.S. Provisional Patent Application No. 60/156,091 filed Sep. 24, 1999.

FIELD OF THE INVENTION

This invention relates to an operating table for use in hand surgery.

BACKGROUND OF THE INVENTION

Hand surgery tables have been used in the medical field to perform surgery on a patient's hand for many years. Conventional hand surgery tables utilize rigid elbow support structures attached in a fixed manner to respective sides of the hand surgery table. The attending surgeon and the nurse assistant utilize the elbow support structures to rest their elbows during the surgical procedure.

Conventional elbow support structures are not pivotable or retractable underneath the hand surgery table. The elbow support structures have a tendency to get in the way during surgery or afterwards when the hand surgery table is detached from a conventional operating table for storage. Additionally, the elbow support structures are rectangularly shaped and boxy and do not permit the attending surgeon or the nurse assistant to sit comfortably at the hand surgery table. Further, the elbow support structures are hard and not cushioned, making it uncomfortable for the attending surgeon to rest his elbows. All of these problems tend to impair the attending surgeon's and the nurse assistant's comfort, maneuverability, and performance during hand surgery on a patient.

SUMMARY OF THE INVENTION

This invention relates to a universal hand surgery table with a top for supporting a patient's arm during hand surgery. Preferably, a concave end of the hand surgery table accommodates the attending surgeon's torso so that the attending surgeon may sit comfortably at the end of the table if the attending surgeon desires to sit at this position. Preferably, a tongue-shaped end portion extends oppositely from the concave end, for securing the hand surgery table to a conventional operating table on which the patient lies and rests his or her forearm on the top of the hand surgery table.

Preferably, pairs of elbow support structures are attached to respective sides of the hand surgery table and include convex peripheries permitting the attending surgeon to sit comfortably at one side of the hand surgery table, and a nurse to sit comfortably at the opposite side of the hand surgery table with the attending surgeon's and the nurse assistant's torsos contacting insides of the curved peripheries and the attending surgeon's and the nurse assistant's elbows supported by the universal hand surgery table. Preferably, the elbow support structures are retractable to the underside of the hand surgery table.

Preferably, the elbow support structures are slidably and retractably mounted with respect to the outer periphery of the hand surgery table. Most preferably, at least one longitudinal tube is provided mounted to the bottom of the hand surgery table, with one tube preferably being provided on either side of the table at which the elbow rests are mounted. Curved, preferably circular brackets preferably fit around the longitudinal tubes and slide therealong. Further desirably, each tube is equipped with one and preferably two indented locking tracks. These locking tracks preferably receive spring mounted, retractable set screws which are connected to the elbow rests. When the set screws are retracted, this allows the elbow rests to slide on the longitudinally elongated tubes underneath the table. The set screws are then used to lock the elbow rests into position by engagement with the opposing indented track. This feature of the elbow rest whereby the longitudinal position of the elbow rests is adjustable permits physicians and attending nurses of differing physical size to sit comfortably at the hand surgery table.

The retractable aspect of the elbow support structure facilitates pivoting movement of the elbow support structures from a position at which the elbow support structures are substantially co-planar with the remainder of the hand surgery table to positions where the elbow support structures have rotated 90° and are below the main surface of the hand surgery table. This facilitates storage of the hand surgery table and provides additional room around the periphery of the table when the elbow support structures are in the retracted position.

The universal hand surgery table of the invention does not employ any legs or other support resting on the floor. Rather, the universal hand surgery table of the invention is essentially cantilevered from a main operating table so that the area beneath the universal hand surgery table of the invention is completely free and clear whenever the universal hand surgery table of the invention is used. This permits the attending surgeon to position image intensifying equipment, such as a fluoroscope, beneath the universal hand surgery table. This also permits the attending surgeon to move freely about the universal hand surgery table since the attending surgeon will normally be seated on a castor-equipped chair.

DETAILED DESCRIPTION OF THE PREFERRED EMBODIMENT

Figure 1:
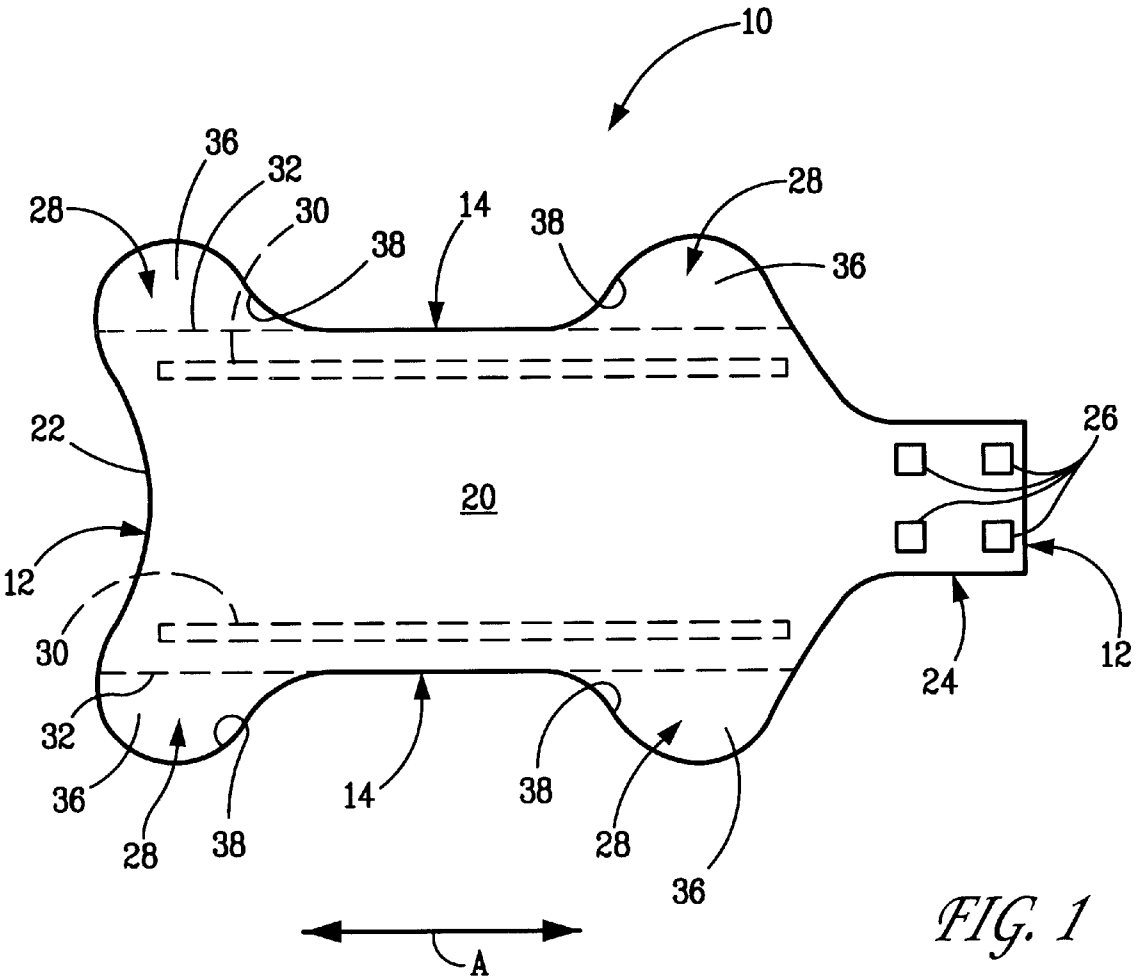
FIG. 1 is a top view of a universal hand surgery table manifesting aspects of this invention.

Referring now to FIG. 1, a universal hand surgery table is designated generally 10. The universal hand surgery table 10 includes a table top 20, a preferably tongue-shaped end portion 24 for attachment to a conventional operating table and elbow support structures 28.

Table top 20 is preferably somewhat rectangular in overall configuration and has respective ends 12 and sides 14. The universal hand surgery table 10 is utilized for supporting a patient's arm during hand surgery. The table top is of suitable length, width and thickness.

Table top 20 may be composed of any suitable sheet material preferably having a smooth, polished upper surface which can easily be sanitized. It should be light yet sufficiently rigid to resist flexing and vibration during use. Preferably, table top 20 is a radiolucent material.

The universal hand surgery table 10 preferably has a concave end 22 and a tongue-shaped end portion 24 at the remaining end. The attending surgeon performing surgery on the patient may be seated at concave end 22 or along either of the two (2) sides 14 of the universal hand surgery table 10. The concave end 22 of universal hand surgery table 10 accommodates the attending surgeon's torso so that the attending surgeon may sit at the end of the table in a position at which the attending surgeon may comfortably rest his or her forearms on table top 20. Similarly, the elbow rests provided along sides 14 accommodate the attending surgeon so that the attending surgeon may sit comfortably on either side of the table and rest his or her forearms on the elbow rests during the surgical procedure. Normally the attending physician would sit along one side 14 of the universal hand surgery table and the nurse assistant would sit at the opposite side 14 of table 10.

The preferably tongue-shaped end portion 24 of table 10 is preferably located at the opposite longitudinal extremity from concave end 22. Tongue-shaped end portion 24 extends from table top 20 for attachment to a conventional operating table to provide a stable mount for hand surgery table 10. Tongue-shaped end portion 24 preferably has a plurality of clamps 26 for clamping the hand surgery table 10 to the conventional operating table. Preferably tongue-shaped end portion 24 is adjustable in the longitudinal dimension, where the longitudinal direction is indicated by Arrow "A" in FIG. 1, and is horizontal with respect to the paper in FIG. 1, so that hand surgery table 10 may be used in conjunction with conventional operating tables of various widths. Preferably tongue-shaped end portion 24 of table 10 is clamped to a conventional operating table at the edge of the conventional operating table remote from the edge of the table from which the hand surgery table 10 extends. With this arrangement, tongue-shaped portion 24 is underneath a patient lying on the conventional operating table so that the weight of the patient on tongue-shaped portion 24 contributes to the stability of universal hand surgery table 10. Further stability is contributed to the hand surgery table by attachment to the remote edge of the conventional operating table.

When hand surgery table 10 is clamped to a conventional operating table, the patient preferably lies in the supine position on the conventional operating table as the patient's outstretched arm is supported by top 20 of hand surgery table 10.

Sides 14 of table top 20 preferably have elbow support structures designated generally 28 for the attending surgeon and the nurse assistant to rest their elbows during surgery. Elbow support structures 28 preferably have convex peripheries 36, permitting the attending surgeon and the nurse assistant to sit at hand surgery table 10 with their torsos comfortably contacting both the sides 14 of table top 20 and the outwardly respective facing edges 38 of elbow support structures 28.

Elbow support structures 28 are connected to, but not fixed to, hand surgery table 10. Elbow support structures 28 are longitudinally moveable in the direction indicated by Arrow "A" in FIG. 1 and may additionally be pivoted or retracted to positions underneath the table. Elbow support structures 28 may be pivoted on hinges 32 which are located underneath hand surgery table 10. Elbow support structures 28 preferably may be rotated about hinges 32 from the position shown in FIG. 1 to a position at which elbow support structures 28 have preferably rotated ninety degrees (90°) and are perpendicular to and underneath the central portion of hand surgery table 10.

Elbow support structures 28 may move on tracks underneath hand surgery table 10. A track is preferably defined by a longitudinally elongated tube 30 where at least one tube 30 is preferably mounted on either side of hand table 10 close to the edge of the table to facilitate mounting of elbow rests 28. Each elbow rest 28 is preferably connected to tube 30 via a circular bracket, preferably by a plurality of such brackets, permitting each elbow rest to then slide along the relevant tube 30 in the longitudinal direction indicated by Arrow "A" in FIG. 1.

Each tube 30 may further include a pair of indented tracks located about 180° apart on the tube. These tracks may serve as anchoring or locking mechanisms for the elbow support 28. In such case, elbow support 28 is preferably equipped with a spring metal retractable set screw. When the set screw is retracted, this preferably allows the elbow rest to retract to a position beneath the table 10 and then have the set screw lock in place on the opposing indented track, thereby retaining the elbow rest in position underneath the table until it is needed for a subsequent surgical procedure.

Top 20 and elbow support structures 28 of hand surgery table 10 are preferably padded. Preferably, table top 20 and elbow support structures 28 are covered with a viscoelastic polymer to provide cushioning for the patients's arm and for the attending surgeon's and the nurse assistant's elbows and forearms during surgery.

It will be recognized by those skilled in the art that changes or modifications may be made to the above-described embodiments without departing from the broad inventive concept of the invention. It should therefore be understood that this invention is not limited to the particular embodiments described herein but is intended to include all changes and modifications that are within the scope and spirit of the invention as set forth in the following claims.

What is claimed is:

1. A hand surgical table, comprising:

1. a top for supporting a patient's arm during hand surgery;
2. a concave end of the surgical table for accommodating an attendant's torso;
3. a tongue-shaped end portion extending from the end opposite from the concave end for attaching the surgical table to a conventional operating table where the patient may lie and rest his forearm on the hand surgical table top; and
4. elbow support structures attached along respective sides of the hand surgical table for movement therethrough in the longitudinal direction having curved peripheries in an operating position at which said support structures having a peripheral portion which is flush with said top of the table, permitting an attendant to sit comfortably at a side of the hand surgical table with the attendant's torso contacting an inside of the curved peripheries and the attendant's elbows supported by the curved peripheries, including means for retracting the elbow support to the underside of the hand surgical table.

2. The surgical table of claim 1 wherein the tongue-shaped end portion is of adjustable size for use with conventional operating tables of various widths.

3. The surgical table of claim 1 wherein the elbow support structures are longitudinally moveable in tracks attached to the underside of the surgical table and include means for retracting the elbow support structures underneath the surgical table.

4. The surgical table of claim 1 wherein the elbow support structures are attached to the sides of the surgical table with hinges via which the elbow support structures rotate to positions underneath the surgical table.

5. The surgical table of claim 1 wherein upwardly facing surfaces of the elbow support structures are padded for providing cushioning for the attending surgeon's and the nurse's assistant's elbows and forearms.

6. The surgical table of claim 1 wherein the elbow support structures and the table top of the surgical table are covered with a viscoelastic polymer to provide cushioning for the patient's arm and for the attending surgeon's and the nurse's assistant's elbows and forearms during the hand surgery.

7. The surgical table of claim 1, wherein the table is void of floor-contacting supports.

8. The surgical table of claim 7, wherein the table underside is clear and free of any table supports.

9. The surgical table of claim 1, wherein the top is made from a material that is radiolucent.

10. A surgical table, comprising:

1. means for supporting a patient's arm during hand surgery;
2. means for attaching the surgical table to a conventional operating table where the patient may lie and rest his forearm on a table top; and
3. means on two sides of said means for supporting a patient's arm during hand surgery for supporting both of an attendant's elbows during hand surgery which are moveable longitudinally along the table and retractable to an underside of the surgical table.

11. The surgical table of claim 10, wherein the table is void of floor-contacting supports.

12. A surgical table, comprising:

a top for supporting a patient's arm during surgery;

a first end portion for attaching the surgical table to a conventional operating table;

a second end portion opposite the first end portion, the second end including a concavity that is sized and configured to accommodate an attendant's torso; and elbow support structures disposed along respective sides of the table;

wherein the surgical table is void of floor-contacting supports.

13. The surgical table of claim 12, wherein the table underside is clear and free of any table supports.

14. The surgical table of claim 12, wherein the first end portion is tongue-shaped.

15. The surgical table of claim 12, wherein the first end portion comprises a plurality of clamps.

16. The surgical table of claim 12, wherein the elbow support structures are movable between a position that is substantially co-planar with the top and a position below the top.

17. The surgical table of claim 16, further comprising a track such that the elbow support structures are further movable along the track away from and toward the nearest of the first end portion and the second end portion.

18. The surgical table of claim 12, further comprising a track such that each of the elbow support structures are movable along the track away from and toward the nearest of the first end portion and the second end portion.

19. The surgical table of claim 12, wherein the respective sides include curved peripheries.

* * * * *